US007264090B2

(12) United States Patent
Vecchiotti et al.

(10) Patent No.: US 7,264,090 B2
(45) Date of Patent: Sep. 4, 2007

(54) ELEVATOR EMPLOYING RADIO FREQUENCY IDENTIFICATION DEVICES (RFIDS)

(75) Inventors: Alberto Vecchiotti, Middletown, CT (US); Adriana Bacellar, Glastonbury, CT (US); Luiz Bacellar, Glastonbury, CT (US); Deborah Haas, Coventry, CT (US); Christian Netter, Vernon, CT (US); Paul Stucky, Vernon, CT (US); William A. Veronesi, Hartford, CT (US); Joseph Zacchio, Wethersfield, CT (US); Bruce Zepke, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 397 days.

(21) Appl. No.: 10/523,119

(22) PCT Filed: Aug. 1, 2002

(86) PCT No.: PCT/US02/24357

§ 371 (c)(1),
(2), (4) Date: Feb. 1, 2005

(87) PCT Pub. No.: WO2004/013030

PCT Pub. Date: Feb. 12, 2004

(65) Prior Publication Data

US 2005/0284706 A1 Dec. 29, 2005

(51) Int. Cl.
*B66B 1/34* (2006.01)

(52) U.S. Cl. ..... 187/391; 187/247

(58) Field of Classification Search ..... 187/247, 187/277, 287, 289, 391–393, 316, 280; 49/26, 49/28, 120; 318/778, 779, 798, 759, 567, 318/569; 340/505, 507, 518, 521, 522, 531, 340/539, 542, 825.69

See application file for complete search history.

(56) References Cited

U.S. PATENT DOCUMENTS

| | | | | |
|---|---|---|---|---|
| 4,742,893 | A | 5/1988 | Otala et al. | |
| 5,708,416 | A | 1/1998 | Zaharia et al. | |
| 5,749,443 | A | 5/1998 | Romao | |
| 5,832,365 | A | 11/1998 | Chen et al. | |
| 6,173,814 | B1 * | 1/2001 | Herkel et al. | 187/288 |
| 6,193,019 | B1 * | 2/2001 | Sirigu et al. | 187/391 |
| 6,446,761 | B1 | 9/2002 | Motoyama et al. | |
| 6,467,585 | B1 | 10/2002 | Gozzo et al. | |
| 6,550,585 | B2 * | 4/2003 | Schoppa et al. | 187/391 |

* cited by examiner

*Primary Examiner*—Jonathan Salata

(57) ABSTRACT

An elevator safety chain includes a plurality of passive radio frequency identification devices (RFIDs) (15-18, 22, 34-36 and 63), which are associated, respectively, with hoistway door locks, upper hoistway limits, lower hoistway limits, overspeed detection, car door lock, emergency stop switch, and inspection switch. RFIDs may be associated with car the call buttons (34) and/or hall call buttons (14, 19). The RFIDs may have a switch (43, 44) in the frequency-determining circuitry (40, 41) which defeats the RFID's ability to respond, or a switch (48) which alters the responding frequency. The RFIDs may sense safe or unsafe conditions, or call requests, by either the presence of absence, or vice versa, of adjacent magnetic reluctance (51, 62, 71).

16 Claims, 2 Drawing Sheets

FIG.8
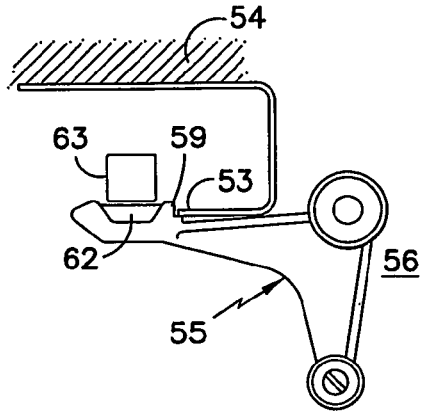
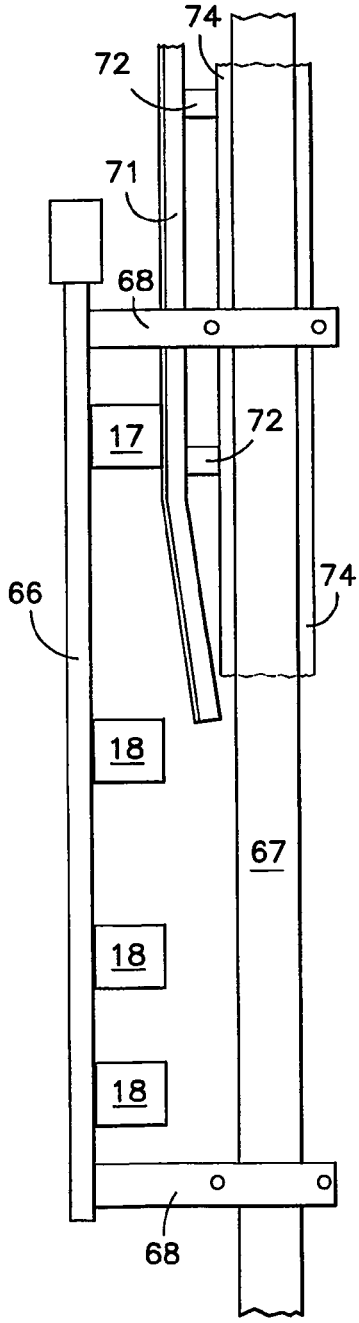
FIG.9

ELEVATOR EMPLOYING RADIO FREQUENCY IDENTIFICATION DEVICES (RFIDS)

TECHNICAL FIELD

This invention relates to an elevator safety chain in which the status or condition of a monitored safety-related parameter of the elevator is communicated by wireless transmission from an interrogated, passive RFID.

BACKGROUND ART

As is known, the safety chain of literally every elevator comprises a series of switches, all of which must be made (closed) so that the entire safety chain is a closed, conductive circuit, otherwise, the elevator is prevented from operating. In the past, elevator safety chains comprised a plurality of discrete switches, each of which have a moveable contact which connects between a pair of circuits when a parameter is in a safe condition, and which disconnects from at least one circuit in the safety chain when the parameter is no longer in a safe condition. Examples of switches in the safety chain are hoistway door lock switches, elevator door switch, emergency stop switch, inspection switch on the top of a cab, upper and lower hoistway limit switches, and the overspeed switch. The various switches are interconnected by wiring, which in turn must conform to local government regulation codes with respect to size and location of wires and conduits. Furthermore, once a building is wired to provide a safety chain, it is difficult to alter the building configuration, or the architectural design of the landings, due to the imbedded wiring. The elevator and hoistway door lock switches must be mounted on the doors themselves, and therefore are connected by flexible wiring either to the cab or to the building, as the case may be.

To overcome the foregoing and other deficiencies in hard-wired, discrete switch safety chains, a wireless safety chain for elevator systems is disclosed in U.S. patent application Ser. No. 09/899,400, filed Jul. 5, 2001. Therein, each parameter related to elevator safety has a sensor related to a wireless communication means, such as transceivers, so that when the monitored parameter becomes unsafe, the condition of the sensor causes the transceiver to be switched off. A master transceiver related to the elevator controller sends a token to a first transceiver, which in turn will send it to the next transceiver, and so forth. It will not be sent through all of the wireless communication means of the safety chain and back to the master transceiver whenever any parameter is in an unsafe condition; thus, the controller will be informed that an unsafe condition exists. Power for the transceivers may be supplied by hardwire to the building power, by passive battery, or by a battery system which is recharged by inductive coupling, such as with a recharging circuit disposed on the elevator car. Use of hardwired power obviates the advantage of a wireless system, in that wires supplied for power are as inconvenient as wires interconnecting the safety chain switches. Battery operation requires far too much maintenance, cost and environmental impact. Inductively coupled recharging systems are complex and unreliable.

The foregoing analysis is applicable as well to call buttons, in the car and at the landings.

DISCLOSURE OF INVENTION

Objects of the invention include a safety chain: having components which rely on neither hardwired power nor batteries; which are passive; in which sensing of the unsafe condition may be integral with the related transceiver; providing improved flexibility, low cost, low maintenance, and ease of upgrading at low cost. Other objects include provision of: improved communication of elevator service calls; integrated wireless transmission of elevator service calls; and simplified, passive communication of elevator service calls.

According to the present invention, transceivers related to various conditions monitored by an elevator safety chain and related to call buttons are passive, comprising, for instance, radio frequency identification devices (RFIDs). According further to the invention, a switch which becomes open upon the existence of an unsafe elevator condition may be connected directly with, or incorporated into the related passive transceiver. In further accord with the invention, the sensing of an unsafe condition may be an integral part of the passive transceiver; an example is the use of adjacent structural parts of the elevator (such as a door component) to either tune or detune the frequency determining circuit of the passive transceiver so as to communicate the safe or unsafe s condition of the corresponding elevator parameter.

As is well known, the RFID is powered by the received electromagnetic energy, and may respond only to a signal of its own unique frequency, or to a signal on a common frequency which however has an address code unique to the individual RFID. The RFID will then respond by transmitting a signal which may contain its address and which, in this case, will contain the condition of the related parameter, in the safety chain or a call button. If an address is not appropriate, the frequency of the RFID will identify the source of the response.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 8 is a partial side elevation view of a hoistway door lock, illustrating how a passive transmitter of the present invention may become tuned when adjacent to a safety-related structural element.

FIG. 9 is a simplified, partial side elevation view of the elevator limits, illustrating how passive transceivers of the invention may become detuned when adjacent to a safety-related structural element.

MODE(s) FOR CARRYING OUT THE INVENTION

Figure 1:
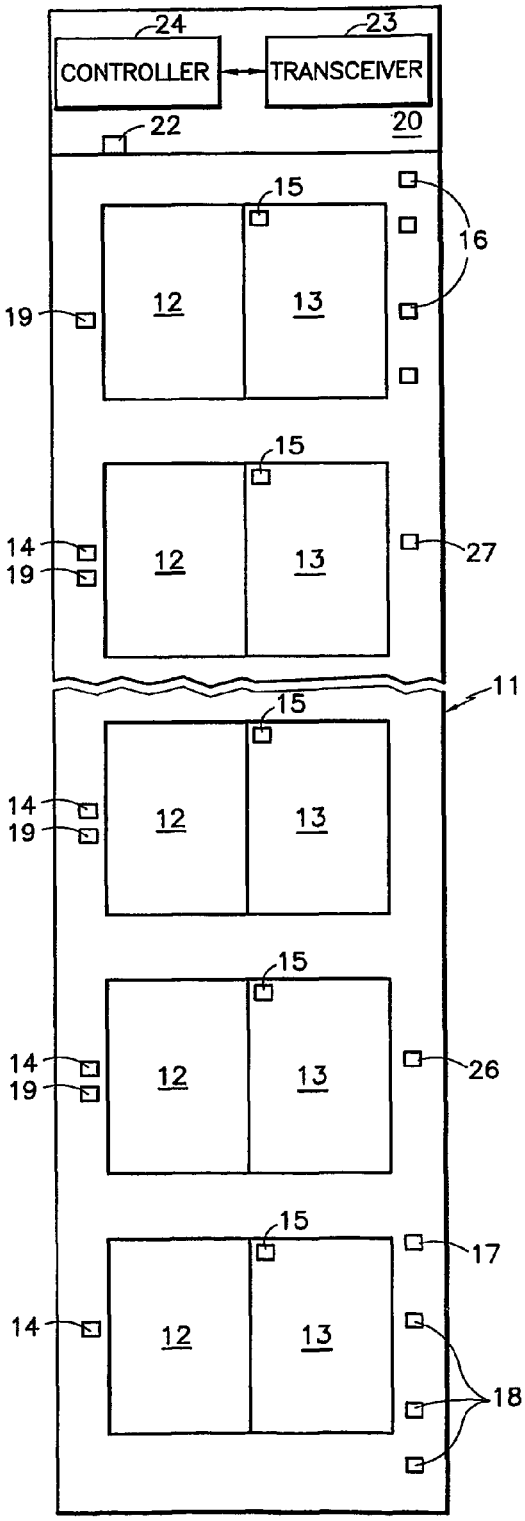
FIG. 1 is a simplified, front elevation schematic of an elevator hoistway and machine room incorporating the invention.

Referring to FIG. 1, a hoistway 11 of an elevator system includes a plurality of hoistway doors 12, 13, there being one set 12, 13 for each landing. Each set has a passive transmitter 15, such as an RFID, associated with the corresponding hoistway door lock. The condition of the door lock is part of the safety chain; if any of the hoistway doors are not locked, the elevator safety chain will fail. Each landing also has an up hall call button with a related transceiver 14 or a down hall call button with a related transceiver 19, or both. The hoistway also has disposed therein a plurality of transceivers 16 related to upper limit switches and a plurality of transceivers 17, 18 related to lower limit switches. In this example, within the machine room 20 of the elevator system, elevator overspeed detection will have a corresponding passive transmitter 22. A transceiver 23 is in,wired communication with the elevator car controller 24, and communicates with other transceivers and passive transmitters in the elevator system. For instance, a transceiver 26 may interrogate the condition of the hoistway doors for the three lowest floors by sending out signals either on a unique frequency or with a unique address code so as to successively interrogate the status of each related door lock as reflected by the corresponding one of the passive transmitters 15. Similarly, the transceiver 26 may interrogate the passive transmitters 17, 18 related to the lower limit switches. A transceiver 27 may interrogate the passive transmitters 15 related to the hoistway door locks of the upper three floors, and may interrogate the passive transmitters 16 to provide indications of the condition of the upper limits. The transceiver 23 will then receive communications from the transceivers 26, 27 indicative of the various passive transmitter responses in the hoistway. The transceiver 23 may also interrogate the passive transmitter 22 to determine the condition of the related overspeed sensor. Depending upon the number of floors in the building, additional transceivers such as transceivers 26, 27 may be provided so as to be within range of all of the transceivers 15 in the hoistway.

Figure 2:
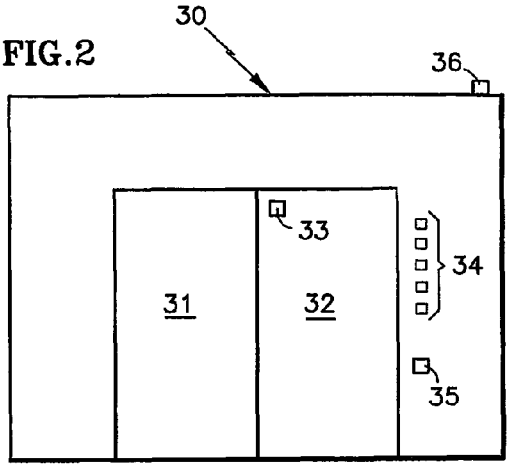
FIG. 2 is a simplified, front elevation schematic of an elevator car incorporating the present invention.

In FIG. 2, an elevator car 30 has a pair of doors 30, 32 and an RFID 33 related to the car door lock switch. The elevator car 30 also has a plurality of car call buttons with related RFIDs 34, and an emergency stop switch with a related RFID 35. As is known, there is also an inspection switch on the top of the cab, and in this case, an RFID 36 related thereto. The RFIDs 33-36 will be interrogated by any of the transceivers 23, 26, 27. There are other conditions in the elevator which are monitored within the safety chain, which are not shown herein for clarity.

Figure 3:
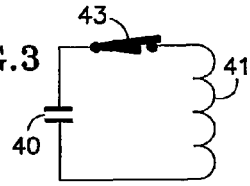
FIGS. 3-7 are simplified schematic illustrations of passive transceiver tuning circuits with which the invention may be practiced.
Figure 4:
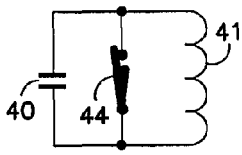
Figure 5:
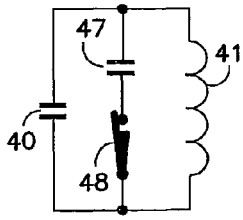

The RFIDs may be arranged so as to reflect the condition of a safety-related parameter of the elevator, in a variety of ways. The simplest are shown in FIGS. 3 and 4 where the frequency-determining RF loop containing a capacitor 40 and an inductor 41 is either opened by a switch 43 (FIG. 3) or shorted by a switch 44 (FIG. 4). Either of these arrangements will cause the RFID to provide no response at all. On the other hand, the RFIDs can be caused to produce two different responses, one indicative of a safe condition and the other indicative of an unsafe condition, as is illustrated in FIG. 5. Therein, an additional capacitor 47 is in series with the switch 48, the two being in parallel with the capacitor 40 and the inductor 41. When the condition is safe, the capacitor 47 is in the circuit, causing the RFID to be responsive at a first frequency. But if the condition becomes unsafe, the switch 48 will become open and the capacitor 47 will no longer be in the circuit; then, the RFID will respond at a different frequency indicative of the unsafe condition. Utilizing a dual response of this type will allow the controller to identify the particular RFID which has sensed an unsafe condition, in contrast with the prior art, serial-switch safety chain which provided no indication of which of the switches has become open and thus no indication of the nature of the failure. In the embodiments of FIGS. 3-5, the switch must be disposed to react to the condition being monitored, and the RFID should be located immediately adjacent thereto, the switch and wiring being accommodated in the frequency-determining loop.

Figure 6:
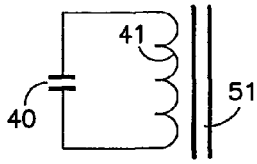
Figure 7:
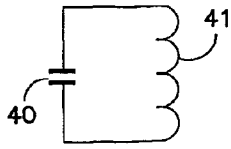

An alternative form of response is illustrated in FIG. 7. Therein, the capacitor 40 and inductor 41 may indicate one condition when the RFID is adjacent to a structure 51 having magnetic reluctance as indicated in FIG. 6, but will have a different frequency when there is no adjacent magnetic reluctance, as illustrated in FIG. 7. This may be utilized either to sense the presence of magnetic reluctance 51 as being the safe condition, or to sense the presence of the magnetic reluctance 51 as being the unsafe condition. The first of these is illustrated with respect to a hoistway door switch, a portion of which is shown in FIG. 8. Therein, the lock selvage 53 (the locking lip) is fastened to the header 54 of the doorway. The locking member 55 is disposed on a hoistway door 56. When a lip 59 engages selvage 53 as seen in FIG. 8, a contact portion 62 (which normally makes a connection between two terminals on the hoistway door lock switch to indicate that the door lock is engaged) will be adjacent to an associated RFID 63 so as to provide tuning of the frequency-determining loop, as illustrated in FIG. 6, so as to provide a response indicative of safety. However, if the portion 62 is not immediately adjacent the RFID 63, the situation will be as in FIG. 7 and the response will either be non-existent, or indicative of an unsafe condition.

The opposite situation may be obtained as illustrated in FIG. 9. Therein, the lower limit switches 17, 18 are shown as disposed on a frame 66 which is mounted to the rail 67 by brackets 68. The well-known cam 71 is disposed by brackets 72 to the stile 74, 15 which comprises the main vertical frame of the elevator platform, as is known. As can be seen, when the elevator gets close to the bottom of the hoistway, the cam 71 will be adjacent to the switch 17, causing it to detune the frequency-determining circuitry, as is illustrated in FIG. 6, and either causing there to be no response from the RFID 17 or, depending upon the protocol being used, a response indicative of the unsafe condition. Obviously, as the elevator goes lower in the hoistway, the cam 71 will become adjacent to additional ones of the RFIDs 18, thus providing the indication of the successive unsafe conditions due to the position of the elevator car in the hoistway. Thus, alteration of the frequency-determining circuit by means of magnetic reluctance can either be utilized so the presence of the reluctance indicates a safe condition (FIG. 8) or an unsafe condition (FIG. 9).

The call buttons may each have a passenger-actuated button switch incorporated into the RFIDs frequency determining circuitry (FIGS. 3-5), or they may each have a passenger-displaced member with reluctance (FIGS. 6 and 7). In systems having button lights to indicate when a call is registered, the lights will normally be wired to building power; the RFID may connect the power through a solid state switch in response to a call confirmation signal transmitted to the RFID. The interrogations should be at a repetition frequency, such as 5 HZ or 10 HZ, sufficient to coincide with button actuation, which may be as short as 200 msec to 500 msec.

The invention claimed is:

1. An elevator safety chain for monitoring the condition of a plurality of safety-related parameters of an elevator, said parameters including at least one of: hoistway door lock, car door lock, upper limits, lower limits, emergency stop switch, inspection switch, and overspeed sensor; characterized by:

at least one transceiver (23, 26, 27) for transmitting interrogation signals and for receiving responses to said interrogation signals; and at least one passive radio frequency identification device (22, 33, 35, 36) (RFID) associated with a corresponding one of said parameters, the frequency determining circuitry (40, 41, 43, 44, 47, 48) of any said RFID being related to said corresponding parameter to have the capability to provide a transmitted response to an interrogation signal from one said transceiver indicative of a safe condition, when the condition of the corresponding parameter is safe, and not providing said indication of a safe condition when the condition of the corresponding parameter is not safe.

2. A safety chain according to claim 1 wherein:

said RFID includes a switch (44, 48) that is opened and closed in response to the condition of the corresponding parameter, said switch associated with frequency-determining circuitry (40, 41) of said RFID so as to cause the frequency determination to result in a transmitted response indicative of a safe condition when said switch is in a position indicative of the fact that the condition of the corresponding parameter is safe.

3. A safety chain according to claim 2 wherein said switch (43, 48) is connected in series with frequency-determining elements (40, 41, 47) of said frequency determining circuitry.

4. A safety chain according to claim 2 wherein said switch (44) is connected in parallel with frequency-determining elements (40, 41) of said frequency determining circuitry.

5. A safety chain according to claim 2 further comprising:

an additional frequency-determining element (47); and wherein said switch (48) connects said additional frequency-determining element to said frequency-determining circuitry.

6. An elevator safety chain according to claim 1 wherein:

said frequency-determining circuitry (40, 41) is responsive to structure having magnetic reluctance adjacent to said RFID; and further comprising:

a structure (51, 71) having magnetic reluctance, the position of which is indicative of the condition of said corresponding parameter, the safe or unsafe condition of said parameter being determined by the presence or absence of said structure immediately adjacent to said RFID in a manner which will alter the frequency of said frequency-determining circuit.

7. A safety chain according to claim 6 wherein the presence of said structure (71) adjacent to said RFID (17) indicates a safe condition.

8. A safety chain according to claim 6 wherein the presence of said structure (71) having magnetic reluctance adjacent to said RFID (18) indicates an unsafe condition.

9. An elevator call system for monitoring at least one of a car call button and a hall call button, characterized by:

at least one transceiver (23, 26, 27) for transmitting interrogation signals and for receiving responses to said interrogation signals; and at least one passive radio frequency identification device (RFID) (14, 19, 34) associated with a corresponding one of said call buttons, the frequency determining circuitry (40, 41, 43, 44, 47, 48) of any said RFID being related to said corresponding call button to have the capability to provide a transmitted response to an interrogation signal from one said transceiver indicative of the button being actuated, when the corresponding button is actuated and not providing said indication of the button being actuated when the corresponding button is not actuated.

10. A safety chain according to claim 9 wherein:

said RFID includes a switch (44, 48) that is operated by the corresponding button, said switch associated with frequency-determining circuitry (40, 41, 47) of said RFID so as to cause the frequency determination to result in a transmitted response indicative of a call request when said switch is in a position indicative of the fact that the corresponding button is actuated.

11. A safety chain according to claim 10 wherein said switch (43, 48) is connected in series with frequency-determining elements (40, 41, 47) of said frequency determining circuitry.

12. A safety chain according to claim 10 wherein said switch (44) is connected in parallel with frequency-determining elements (40, 41) of said frequency determining circuitry.

13. A safety chain according to claim 10 further comprising:

an additional frequency-determining element (47); and wherein said switch (48) connects said additional frequency-determining element to said frequency-determining circuitry (40, 41).

14. An elevator safety chain according to claim 9 wherein:

said frequency-determining circuitry is responsive to structure having magnetic reluctance adjacent to said RFID; and further comprising:

a structure having magnetic reluctance, the position of which is determined by said corresponding button, the actuated or unactuated condition of said button being indicated by the presence or absence of said structure immediately adjacent to said RFID in a manner which will alter the frequency of said frequency-determining circuit.

15. A safety chain according to claim 6 wherein the presence of said structure adjacent to said RFID indicates a call request.

16. An elevator system including a safety chain for monitoring the condition of a plurality of safety-related parameters of an elevator, said parameters including at least one of: hoistway door lock, car door lock, upper limits, lower limits, emergency stop switch, inspection switch, and overspeed sensor; said elevator system also for monitoring at least one of a car call button and a hall call button, characterized by:

at least one transceiver (23, 26, 27) for transmitting interrogation signals and for receiving responses to said interrogation signals;

at least one passive radio frequency identification device (safety RFID) (22, 33, 35, 36) associated with a corresponding one of said parameters, the frequency determining circuitry (40, 41, 43, 44, 47, 48) of any said safety RFID being related to said corresponding parameter to have the capability to provide a transmitted response to an interrogation signal from one said transceiver indicative of a safe condition, when the condition of the corresponding parameter is safe, and not providing said indication of a safe condition when the condition of the corresponding parameter is not safe; and at least one passive radio frequency identification device (call RFID) (14, 19, 34) associated with a corresponding one of said call buttons, the frequency determining circuitry of any said call RFID being related to said corresponding call button to have the capability to provide a transmitted response to an interrogation signal from one said transceiver indicative of the button being actuated, when the corresponding button is actuated, and not providing said indication of the button being actuated when the corresponding button is not actuated.

* * * * *